US006502796B1

(12) United States Patent
Wales

(10) Patent No.: US 6,502,796 B1
(45) Date of Patent: Jan. 7, 2003

(54) SHOWER HEAD HOLDER

(75) Inventor: Michael Wales, Riverside, CT (US)

(73) Assignee: Resources Conservation, Inc., Stamford, CT (US)

( * ) Notice: Subject to any disclaimer, the term of this patent is extended or adjusted under 35 U.S.C. 154(b) by 0 days.

(21) Appl. No.: 09/541,279

(22) Filed: Apr. 3, 2000

(51) Int. Cl.[7] ..... A47G 1/10

(52) U.S. Cl. ..... 248/316.1; 4/597; 4/605; 248/230.1

(58) Field of Search ..... 248/75, 76, 229.16, 248/229.26, 229.13, 316.1, 316.4, 316.5; 4/615, 605, 597; 239/547, 576, 579, 588

(56) References Cited

U.S. PATENT DOCUMENTS

| | | | | |
|---|---|---|---|---|
| 2,966,311 A | | 12/1960 | Davis | |
| 3,404,410 A | | 10/1968 | Sumida | |
| 3,747,166 A | * | 7/1973 | Eross | 248/75 |
| 3,749,345 A | * | 7/1973 | Luder et al. | 248/230 |
| 3,865,310 A | | 2/1975 | Elkins et al. | |
| 3,979,096 A | | 9/1976 | Zieger | |
| 4,174,822 A | | 11/1979 | Larsson | |
| 4,719,654 A | * | 1/1988 | Blessing | 4/597 |
| 4,964,573 A | | 10/1990 | Lipski | |
| 5,220,697 A | | 6/1993 | Birchfield | |
| 5,265,833 A | | 11/1993 | Heimann et al. | |
| 5,632,049 A | | 5/1997 | Chen | |
| 5,652,973 A | | 8/1997 | Blue | |
| 5,704,080 A | | 1/1998 | Kühne | |
| 5,833,192 A | | 11/1998 | Buhrman | |
| 6,123,308 A | * | 9/2000 | Faisst | 248/316.1 |

FOREIGN PATENT DOCUMENTS

| | | | |
|---|---|---|---|
| DE | 4106878 | * | 10/1992 |
| JP | 8-260535 | * | 8/1996 |

* cited by examiner

*Primary Examiner*—Anita King
*Assistant Examiner*—Tan Le
(74) *Attorney, Agent, or Firm*—St. Onge Steward Johnston & Reens LLC

(57) ABSTRACT

An adjustable mount for removable attaching a showerhead to a water supply pipe includes a mounting bracket made of resilient material and having a mounting flange which is sized and shaped to clamp the water supply pipe upon applying an external force. The adjustable mount further includes a holder for the showerhead and an attaching assembly for releasably attaching the holder to the mounting bracket. The attaching assembly has a knob formed on either the holder or the mounting bracket frictionally engaging a recess formed on the other element. Upon inserting the knob in the recess, the bracket and the holder are displaceable relative to one another between a release position, wherein they are freely detachable, and a series of locking positions, wherein their displacement is arrested upon ceasing an external torque.

6 Claims, 4 Drawing Sheets

SHOWER HEAD HOLDER

FIELD OF THE INVENTION

The present invention relates to a mounting bracket for a plumbing fixture. More particularly this invention relates to a set including a mounting bracket which is easily attachable to a water supply pipe and a holder for a hand shower which is detachably mounted to the mounting bracket and is displaceable relative thereto.

BACKGROUND OF THE INVENTION

Hand-held showerheads are experiencing a surge in popularity. Such showerheads are convenient in use, esthetically appealing and easily replaceable without help from a professional plumber. Numerous designs of mounting arrangements for hand-held showers have been introduced; however, many of the known designs have certain disadvantages.

Some of the known mounting arrangements are unjustifiably complicated and, thus, costly. Still other known structures may not be sufficiently reliable in use and, thus, may be a subject to their frequent replacements. Yet other known structures are difficult to install, thereby undermining such an advantage as an easy installation those hand-held showerheads may have over standard wall mounted showerheads.

Conventional showerhead mounts typically comprise an elongate support which rigidly attaches to a shower surround wall and a holder connected to the support for holding the showerhead. In the past, the support was usually attached to the wall with semi-permanent means such as with adhesives and/or fasteners which penetrated the surface of the wall. For example, screw fasteners and permanent adhesives were customarily used to attach the support to the wall.

Frequently, adjustable mounts are used in combination with hand-held showerheads to permit the level of the showerhead to be lowered from a typical wall-mounted showerhead level for use by children and the infirm. The adjustability of the mount permits the shower head to be changed as the children grow to accommodate their increasing height, and permits temporary repositioning of the shower head when persons of differing heights use the shower. Once the children are grown, it is often desirable to remove the mount from the shower surround wall to restore the shower to its original condition and appearance. To overcome the problems associated with removal of the above-discussed adjustable mounts, structures allowing adjustable mounts to be attached to existing water supply pipes are became increasingly popular.

U.S. Pat. No. 3,979,096 discloses an adjustable mount for a hand-held shower head including a mounting bracket, which surrounds a water pipe, and a showerhead holder, which has a forked seat screwed to the mounting bracket. The mounting bracket has an opening receiving the water pipe and is sandwiched between a pair of nuts preventing its displacement along the pipe. The showerhead holder is displaceable relative to the bracket upon loosening of a screw, which threadedly engages both, the bracket and the holder. Thus, if one needs to adjust position of the entire structure relative to the water pipe, one has to first loosen the nuts, and then to tighten them up so as to fix a desirable position that has been reached upon displacement of the bracket.

Having established a position of the mounting bracket, one may have a number of reasons for establishing a new angular position of the showerhead holder relative to the bracket. For example, one of the reasons may be the fact that a water jet does not reach a desirable destination to be washed. Still another reason may be the fact that the showerhead is to be used for a standard stationary shower use. To accomplish displacement of the holder, one has to manipulate the screw which is, perhaps, time consuming and not always convenient.

U.S. Pat. No. 4,174,822 to Larsson discloses an adjustable mounting bracket having two flexible shanks which form a seat for a water pipe and a showerhead holder pivotal on the a pin which traverses the arms. An array of formations between the holder and the shanks allow the holder to frictionally move relative to the mounting bracket. As is the case with the previously discussed reference, one has to manipulate a fastener to displace the bracket along the water pipe. Additionally, in case of the damaged showerhead, the adjustable mount should be completely disassembled in order to mount a new showerhead on the pin.

U.S. Pat. No. 5,632,049 discloses an adjustable mount including a mounting bracket, which has a handle locking the bracket in the desirable position relative to a water pipe, and a showerhead holder. Mounted between the holder and the bracket is a ball bearing allowing these two elements to move relative to one another. However, if either of the elements needs to be replaced, one has to dismantle the entire assembly in order to separate the holder from the bracket.

What is desired, therefore, is an adjustable mount for a showerhead, and the like which has a mounting bracket that can be easily attached to a water pipe. Also, a showerhead holder that can be displaceable relative to the mounting bracket is desirable, as is a structure allowing the adjustable mount to be easily disassembled.

SUMMARY OF THE INVENTION

With an adjustable mount of this invention a mounting bracket can be easily mounted to a water pipe and to a showerhead holder. More particularly, the adjustable mount includes a mounting bracket made of resilient material and having a mounting flange, which temporarily expands upon applying an external force during mounting of the bracket on the pipe.

An attaching assembly, in accordance with one aspect of the invention, allows the showerhead to be easily connected to the bracket to have these elements easily assembled. Specifically, the attaching assembly includes a pin located on one of the connectable elements and a recess formed on the other element. The recess has a rib extending along a part of a periphery of the recess and having a shape allowing a radial arm of the pin to be effortlessly inserted in the recess. Once the mounting bracket and the holder are attached to one another, angular displacement of one of the elements relative to another provides a reliable engagement between the rib and arm. An external torque applied to one of the attached elements and sufficient to overcome frictional forces between the rib and arm displaces the elements to a locking position, wherein further movement in a direction of the torque is arrested.

In accordance with another aspect of the invention, the mounting bracket has a mounting flange resiliently clamping the water pipe and a body extending from the mounting flange and having a collar which guides an edge of the holder during its displacement relative to the bracket. Thus, two separate regions including one between the arm and the rib and the other between the edge and the collar ensure reliable displacement of the holder relative to the bracket.

All of the elements are made of resilient material, such as plastic or a durable synthetic resin, allowing the elements to elastically deform upon applying an external force and to assume their original dimensions and positions upon ceasing of this force. Thus, the mounting flange serving as a seat for the water pipe has its shanks expanded upon applying an external force by a user, so that the water pipe is reliably clamped upon its insertion.

A combination of the mounting bracket and showerhead holder may also include a new relatively short pipe having an elbow between its opposite ends and shaped and sized to be reliably clamped by the mounting flange. By having differently sized threaded ends of the pipe, the adjustable mount can be easily attached to differently sized main water pipes.

It is, therefore, an object of the present invention to provide an adjustable mount including a mounting bracket and a showerhead holder that are displaceable relative to one another to provide a series of angular positions for a showerhead with respect to the mounting bracket.

Another object of the invention is to provide a mounting bracket including a mounting flange that can be easily attached to existing water pipes by applying an external force.

Still another object of the invention is to provide an adjustable mount including a combination of a mounting flange and a showerhead holder that can be easily and reliably attached to one another.

Yet another object of the invention is to provide an attaching assembly allowing a showerhead holder and a mounting bracket to be angularly displaced relative to one another between a position wherein they are displaceably fixed and a position wherein the holder is detached from the bracket.

BRIEF DESCRIPTION OF THE DRAWINGS

The above and other objects, features, and advantages will become more readily apparent from the following, reference being made to the accompanying drawings, in which.

DETAILED DESCRIPTION OF THE DRAWINGS

Figure 1:
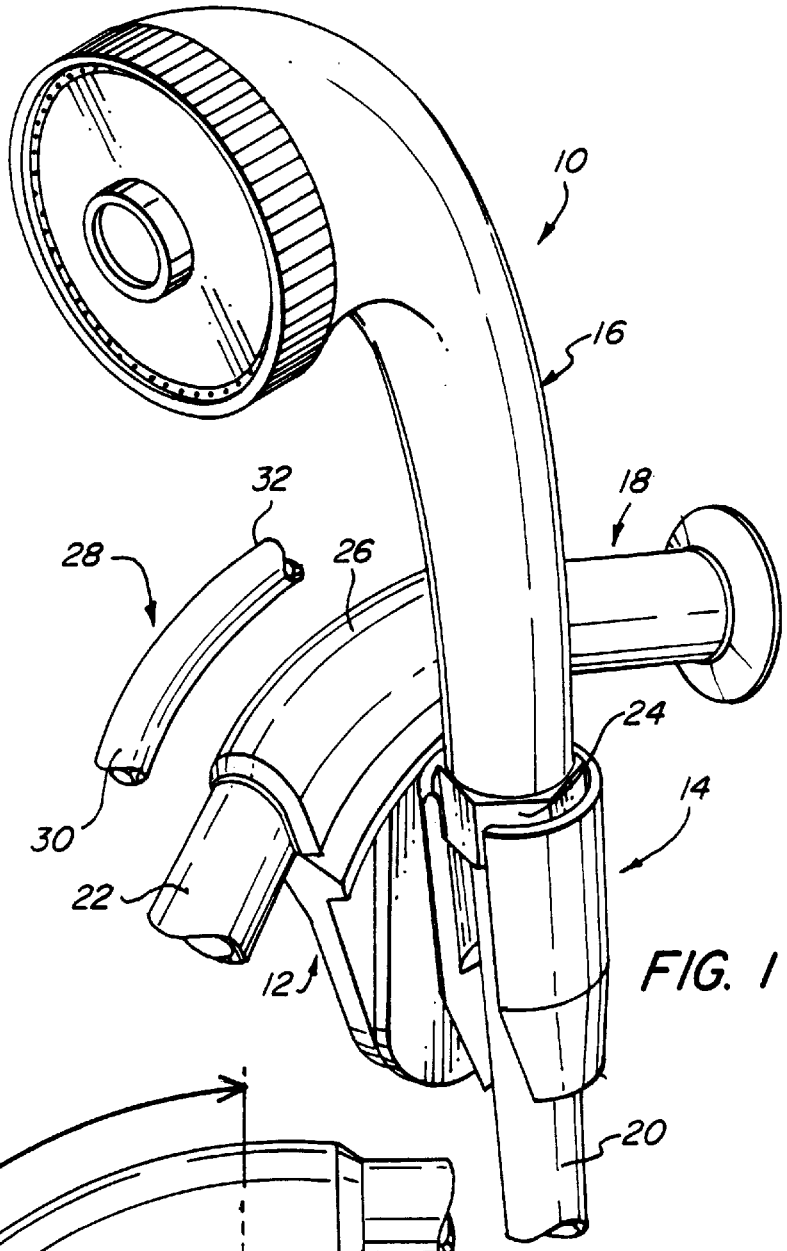
FIG. 1 is an isometric view of an adjustable mount shown with a showerhead.
Figure 3:
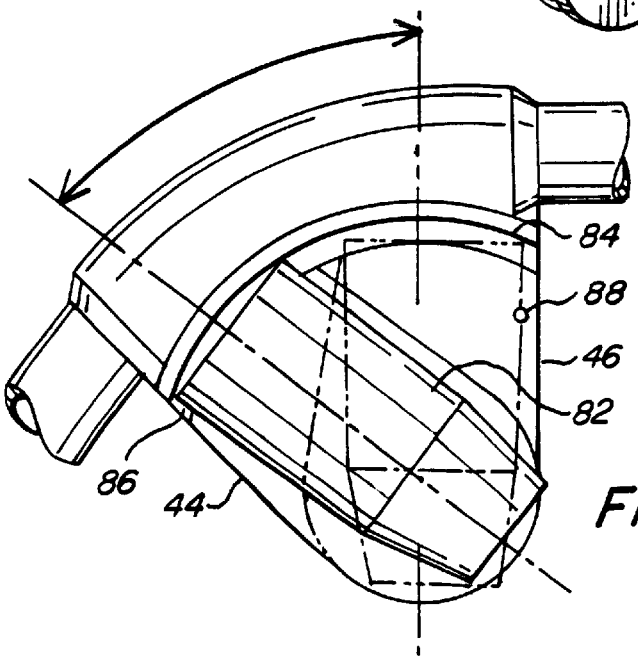
FIG. 3 is a diagrammatic partially broken away view illustrating relative displacement of a showerhead holder and a mounting bracket.
Figure 2:
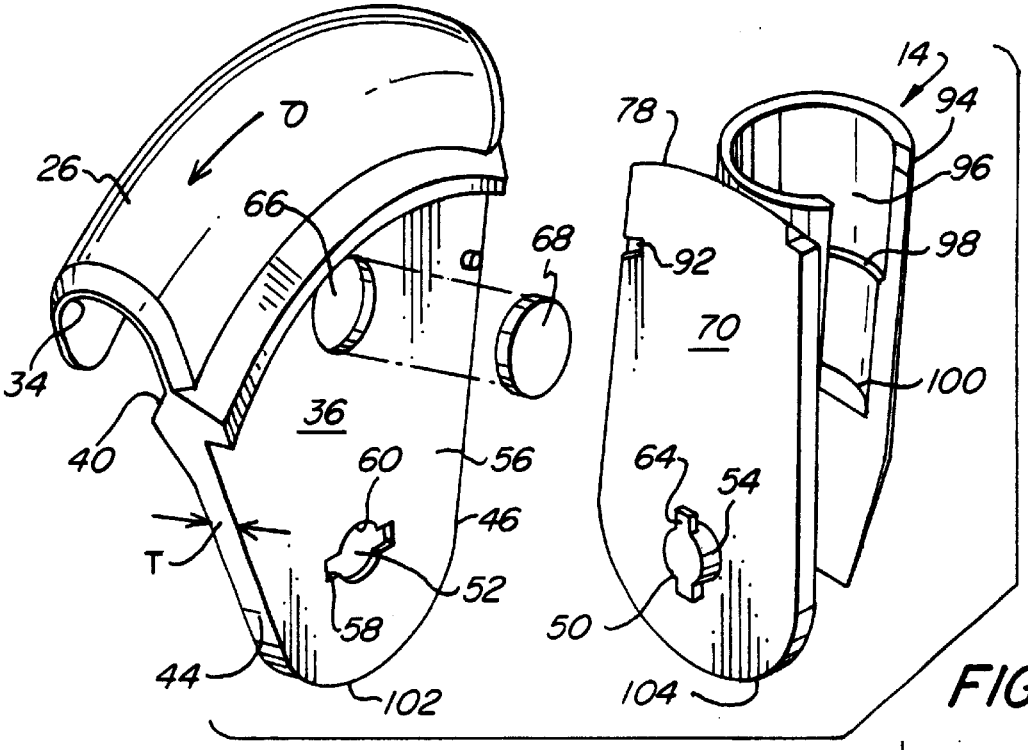
FIG. 2 is an isometric exploded view of the adjustable mount shown in FIG. 1.
Figure 4:
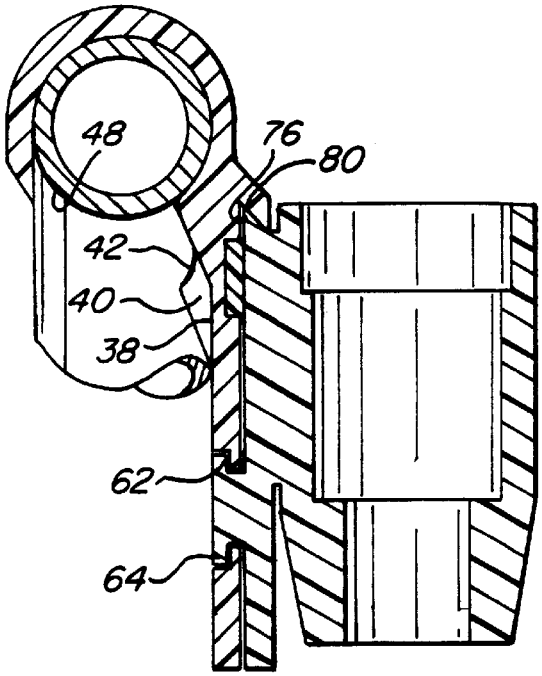
FIG. 4 is a cross-sectional view of the adjustable mount shown in FIG. 1 and illustrated in a locking position.
Figure 5:
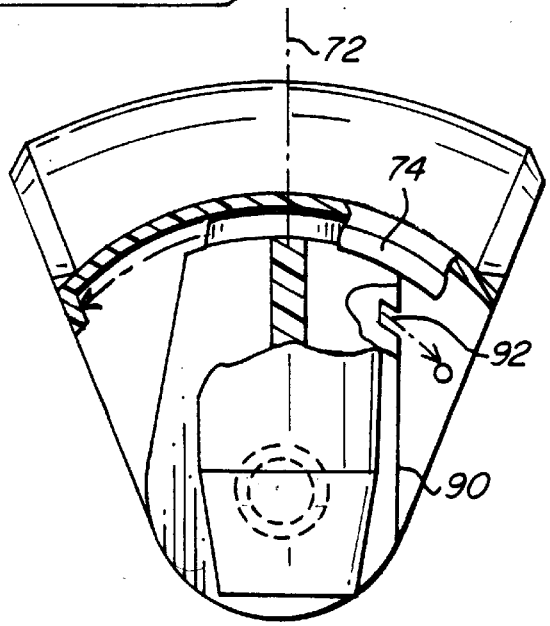
FIG. 5 is a partially broken away cross-sectional view illustrating the showerhead and mounting bracket of the adjustable mount in an intermediate angular position.
Figure 6:
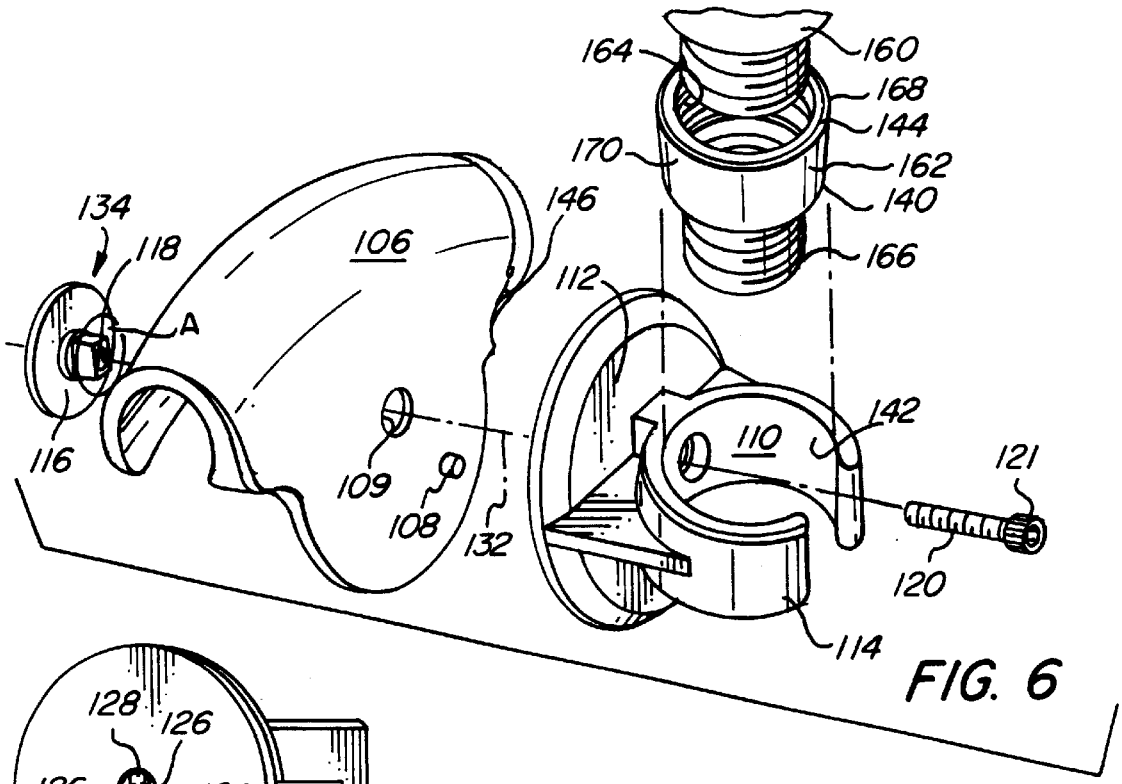
FIGS. 6 and 6A are an isometric exploded view of an adjustable mount and a perspective view with a showerhead in accordance with another embodiment of the invention.

Referring to FIGS. 1–7, an adjustable mount 10 attachable to a water supply pipe 18 includes a mounting bracket 12 and a showerhead holder 14 shaped and sized to support a showerhead assembly 16. The water supply pipe 18 has an outer end 22 attached to one of the opposite ends of a flexible hose 20 whose other end engages the showerhead holder. The ends of the hose 20 may contain couplers 24, only one of which is shown here. In addition, the adjustable mount may include an elbowed pipe 28 which has a length slightly exceeding a length of a mounting flange 26 of the bracket 12 and opposite threaded ends 30, 32 which receive couplers sized and shaped to engage variously dimensioned water supply pipes.

In accordance with one aspect of the invention, the mounting bracket 12 is a molded one piece element having a mounting flange 26 which serves as a seat 34 (FIG. 2) shaped and sized to receive the water pipe, as shown in FIG. 1 and a support body 36. Due to the inherent elasticity of plastic or a durable synthetic resin, opposite shanks of the mounting flange tend to expand upon applying an external force to the bracket in order to peripherally surround at least part of the water pipe reliably received in the seat 34. To ensure that the water pipe and the bracket 12 are displaceably fixed relative to each other, an inner side 38 of the support body 36 of the bracket has a support 40 abutting the periphery of the water pipe after it has been inserted in the seat 34. The support is molded with its supporting surface 42 extending complimentary to a portion of the periphery of the water pipe, and, thus, providing a relatively wide area of contact between the support and the water pipe. The supporting surface can be continuous extending between opposite flanks 44, 46 of the body 36 or can have a number of separate and spaced apart regions. The mounting flange 26 has a semi-circular cross section with a radius of curvature, which is at most equal to that one of the water pipe. Such structure allows the mounting flange to run into the supporting surface 42 of the support 40. Thus, only a relatively short sector 38 of the water pipe remains unsupported which allows a user to displace the mounting bracket 12 along the water pipe to a desirable position upon applying an external force.

In accordance with another aspect of the invention, the showerhead holder 14 and the mounting bracket 12 are releasably attached to one another by an attaching assembly including a knob 50 and a recess 52 that are shown on the holder 14 and the bracket 12, respectively. Note that these formations are given only as an example, and the holder can have the recess, whereas the bracket can be formed with the knob. These formations allow the holder 14 and the bracket 12 to be freely attached in one angular position and, after applying an external torque, to be angularly displaced along a series of positions, wherein their relative displacement is arrested.

Specifically, the knob 50 having generally a T-cross-section includes a pin 54 having an inner end, which faces the mounting bracket, and a pair of radial arms 64 extending diametrically opposite from one another and radially outwardly from the inner end of the pin. The thoroughgoing recess 52 has a peripheral surface which is annular on the inner side 38 of the body 36 of the bracket and is complimentary to the outer surface of the knob, which includes its inner end and the arms, on an outer side 56 of the body 36. Thus, the peripheral surface of the recess 52 formed on the outer side 56 has a pair of polygonal segments 58 extending diametrically opposite one another and a pair of arcuate segments 60 between the polygonal ones.

In order to displaceably interengage the mounting bracket and the holder, the peripheral surface of the recess has two spaced apart radial ribs 62, each extending along a sector of the periphery and having a thickness less than a thickness T of the support body 36. Thus, the ribs 62 terminate at a distance from the inner side 38 of the support body 36 and are engaged by the arms 64 after the knob 50 has been freely inserted in the recess and displaced in a direction D. Thus, the knob 50 is first aligned with the recess 52, and, after the arms 64 have passed through the polygonal segments 58 of the recess 50, the bracket and holder are displaced to have the ribs 62 engaged by the arms 64.

The knob 50 has a thickness substantially equal to the thickness T of the support body 35 to allow the inner end of the pin 50 to lie flush with the inner side of the support body. The arms 64 are so sized that angular displacement of the holder relative to the mounting bracket may be practically uninhibited, thus preserving their engaging surfaces from unnecessary wear. In order to register a desirable angular position, the outer side 56 of the support body 36 has a blind hole or socket 66 spaced from the recess 52 and receiving a friction pad 68 which is made of friction material, such as a durable synthetic resin and the like. Preferably, the friction pad is either adhered to the bottom of the hole or press-fit in the socket. Similarly to the attaching assembly, the socket and the friction pad can be easily formed on the holder. Preferably, the pad is located along an axis of symmetry 72 of the mounting bracket 12.

The hole and the pad are so sized that an outer end of the pad slightly extends from the outer side 56 to have frictional contact with a support plate 70 of the holder 14. This contact can be easily overcome upon applying an external torque but, at the same time, it is sufficient to prevent voluntary displacement of the holder and the bracket. As a result, a user can easily attach the holder to the mounting bracket that has been mounted on the water pipe and select a desirable angular position of the holder and, thus, the showerhead upon applying a torque to the holder.

In accordance with still another aspect of the invention, the adjustable mount has a guide preventing the holder 14 and the mounting bracket 12 from deviation during their relative displacement. Particularly, a collar 74 formed on the outer side 56 of the support body 36 (FIG. 5) extends between its opposite flanks 44, 46 and has a slanted inner surface 76 extending toward the recess 52. The collar is sized to receive an edge 78 of the support plate 70 of the holder 12 which also has a slanted surface 80 extending complimentary to the inner surface 76 of the collar upon engagement between the support plate and the collar. Due to the friction pad 68, the support plate 70 is pressed upon by the pad to enable its surface 80 to urge against the inner surface of the 76 of the collar. This engagement of the surfaces along with an engagement between the ribs and the arms prevents the holder and the bracket from voluntary displacement and assures a desirable angular position of the holder upon ceasing of an external force.

The collar is sized so that when the surfaces 76 and 80 engage one another, its edge 84 (FIG. 3) is flush with an outer side 82 of the support plate making the whole adjustable mount esthetically appealing. One of the opposite ends of the collar has an abutment flange 86 extending along the flank 44 and arresting further displacement of the holder in a locking position thereof. The body 36 of the mounting bracket has a retractable stopper 88, such as a screw, located close to the opposite flank 46 of the body 36 and extendable from its outer side 56 to block displacement of the holder in a direction opposite to a direction of insertion D. To provide an appealing design, the inner side of the support plate 70 has a groove 92 (FIG. 5) extending from a trailing flank 90 of the support plate, thus making the stopper 88 not visible from the outside. Thus, the structure has two spaced-apart stoppers defining a path therebetween along which the holder can have a number of easily fixed angular positions allowing the user to adjust a water jet if the showerhead is used in a conventional manner.

Note that the collar, although shown to be arcuate, can have different shapes, such as a linear shape, which will necessitate a change in a shape of the edge of the support plate of the holder. Further, although the collar has been described to be on the mounting bracket, it is easy to see that such collar can be located on the holder and receive an engaging element formed on the bracket.

The holder 14 has the support plate 70 molded in one piece with a shower support 94, which has a U-shape and narrows toward its bottom to enable the showerhead to be slightly wedged, as known in the art. An inner surface 96 of the shower support 96 has a series of peripherally extending ribs 98, 10 to conform to respective variously dimensioned regions of the showerhead.

The body 36 of the mounting bracket has generally a conical shape with a curved bottom 102. Both, the bottom 102 and a bottom 104 of the support plate are curved and have the same radius of curvature. As a consequence, while the plate and the bracket are displaceable along the path between the abutment flange 86 and the stopper 88, the bottom 104 of the plate does not extend over opposite flanks 44, 46 of the bracket.

Figure 7:
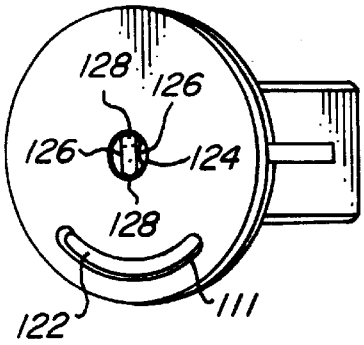
FIG. 7 is an isometric view of a holder of the adjustable mount shown in FIG. 6.
Figure 6B:
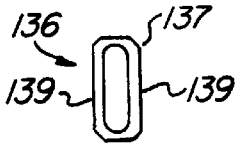
FIG. 6B is an enlarged view on an outer end of a detail A shown in FIG. 6.
Figure 6A:
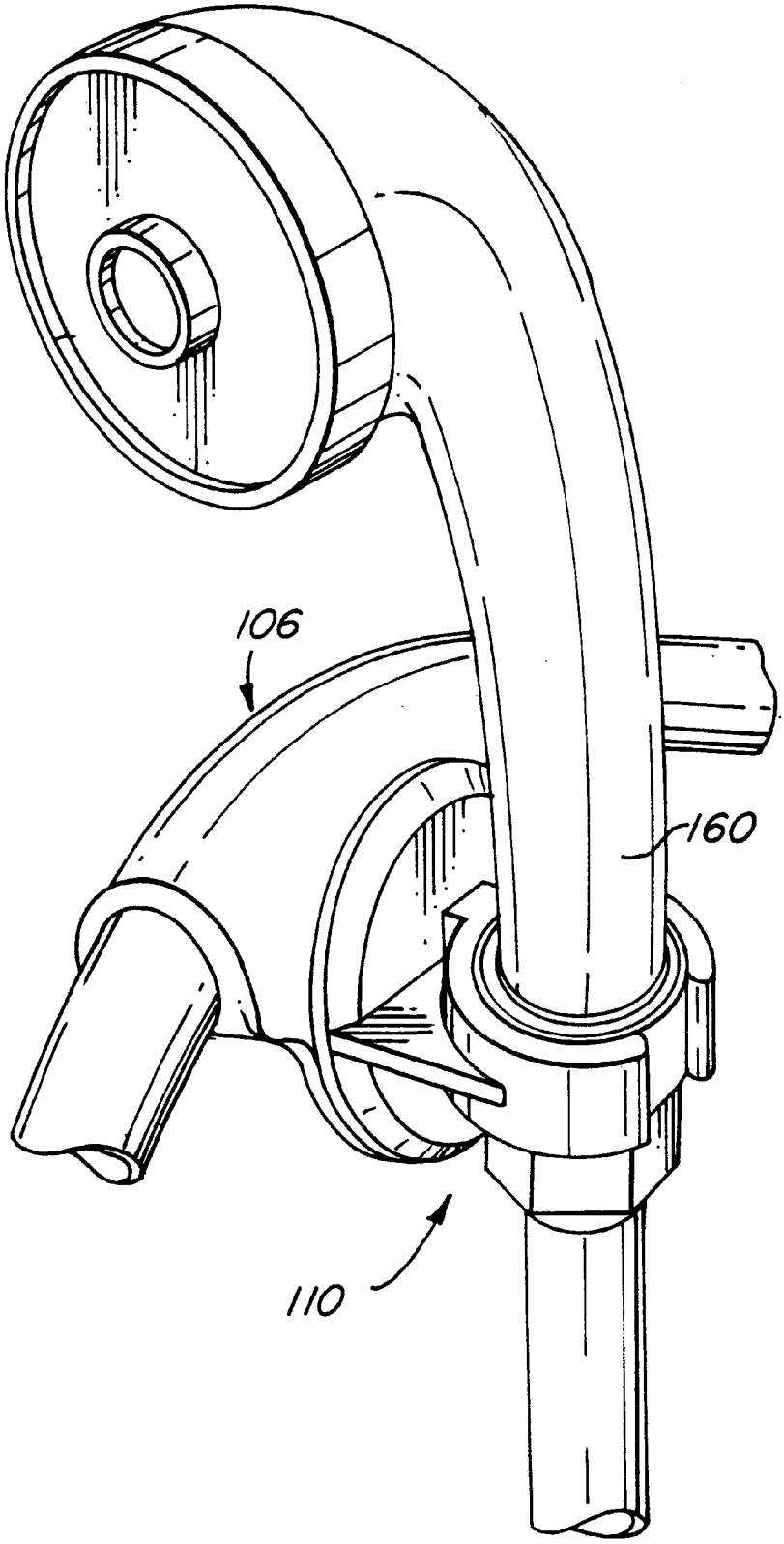

FIGS. 6–9 illustrate another embodiment of an adjustable mount in accordance with the invention. Similarly to the previously disclosed adjustable mount, this embodiment includes a mounting bracket 106 and a shower holder 110 receiving a showerhead 160 (FIG. 6A), the latter of which preferably is a one-piece body comprised of a shower support 114 and a support plate 112. The support plate 112, as shown in FIG. 7, has an inner surface 111 which is formed with a blind hole 122 preferably having an arcuate shape and serving as a guide for the bracket 106 after the mount has been assembled, as will be explained hereinbelow. The hole 122 terminates at a distance from a peripheral edge of the plate, but can be formed bridging an annular peripheral edge of the plate, as has been explained in reference to the previously disclosed embodiment. The hole 124 extending along an axis 132 has opposite axial inner and outer ends sized to have the same relatively large diameter generally corresponding to a screwhead 121 of an attaching screw 120. Extending between the opposite axial ends of the hole 124 is an intermediary part 130 (FIG. 9) whose diameter is relatively small and is slightly greater than a diameter of a threaded shank of the attaching screw 120. As shown in FIG. 7, the inner end of the hole 124 extending between the inner side 111 of the support plate and the intermediary part of this hole has a pair of axially extending ribs 126 spaced equidistantly apart from the axis 132. As a consequence, this end has a recess defined between two arcuate opposite sectors 128 and two flat segments, which are formed by inner surfaces of the ribs facing one another.

Attachment of the mounting bracket to the shower holder 110 is provided by a fastener assembly 134 mounted to the mounting bracket 106. This assembly 134 is comprised of a flange 116 abutting an inner side 107 (FIG. 9) of the mounting bracket 106 and having a shank 118. The shank is sized to allow the assembly to fit a central hole 109 formed in the mounting bracket 106 and to rotate relative thereto only upon applying an external torque. As better shown in FIG. 6B, an outer end 136 of the shank has an outer surface 137 which is formed complimentary with an inner surface of the inner end of the hole 124 of the shower holder 110. Thus, the outer end 136 of the shank is received in the inner end of the hole 124 in an engaging position, wherein its long flat sides 139 engage the flat segments of the hole 124 to angularly displace the bracket and shower holder relative one another. An external torque applied to the shower holder should be sufficient enough to angularly displace the fastener assembly 134 relative to the bracket 106. The shank 118 further has an axial channel whose periphery 133 (FIG. 9) is threaded in order to engage the fastening screw 120 for arresting axial displacement between the mounting bracket and the shower holder.

Figure 8:
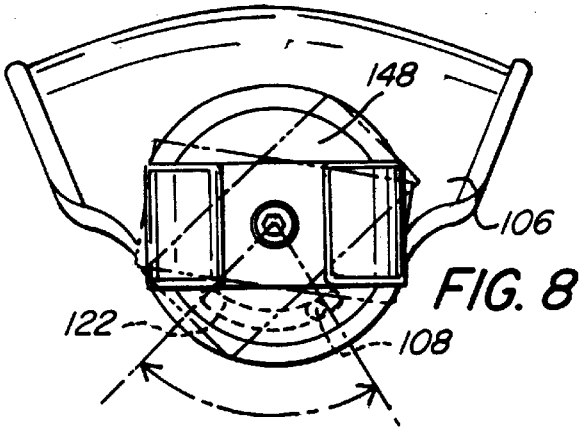
FIG. 8 is a front elevational view of the adjustable mount of FIG. 6.
Figure 9:
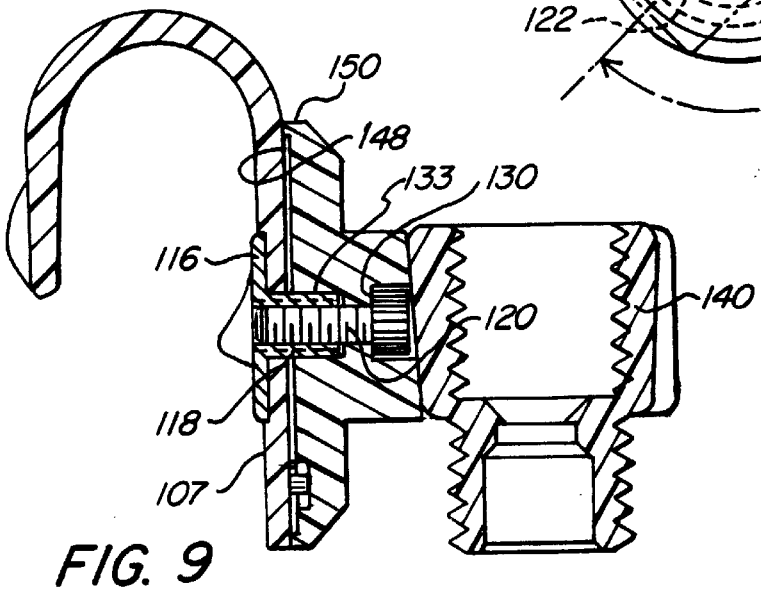
FIG. 9 is a side cross-sectional view of the adjustable mount of FIG. 6.

An outer surface of the bracket has a pin 108 extending toward and engaged in the arcuate hole 122 of the shower holder during its attachment to the bracket. Insertion of the shank 118 in the hole 124 is registered when the outer end of the shank 118 pressed against the intermediate part 130 of the hole 124 receives the attaching screw 120 defining, thus, the engaging position, wherein the pin 108 rests in the hole 122. After attaching the bracket to the shower holder 110, a user can adjust their mutual angular position by applying an external torque to either of these elements causing the shank 118 to rotate in the hole 109 upon overcoming a friction force otherwise preventing free displacement of the shank. Relative displacement of the bracket and holder is arrested at extreme angular positions which are defined by opposite ends of the curved hole 122 pressing against the pin 108, as shown in FIG. 8. Due to the comparable dimensions of the shank and the hole allowing them to frictionally engage one another, a user can obtain a plurality of intermediate positions between the shower holder and the bracket, in each of which no further displacement is possible unless caused by an external torque.

Similarly to the embodiment described in reference to FIGS. 1–5, the mounting bracket 106 has a body 146 which is formed with a bearing surface 148. Preferably the body has an annular segment which is in continuous circumferential contact with the inner surface 111 of the shower holder 110 during the entire displacement of the holder relative to the bracket between the opposite extreme angular positions. Particularly, this inner surface 111 has an annular rim 150 (FIG. 9) extending therefrom to press against the bearing surface 148, thereby preventing the components from premature wear.

According to another feature of the invention, an adjustable mount can include a universal fitting 140 adapted to receive a showerhead 160 and fit differently shaped and sized shower supports. Particularly, the universal fitting 140 has a body 170 extending between opposite inner 166 and outer 168 ends. The inner end 166 has an outer threaded periphery sized to receive differently sized hoses, which may have threaded fittings to threadedly engage the outer periphery. The outer end 168 has a flange 170 formed with an inner peripheral surface 164 having generally a cylindrical shape and provided with a thread to threadedly engage a showerhead 160.

A great variety of shower supports having their inner surfaces differently shaped and sized typically necessitates simultaneous replacement of the entire mount and the shower head, because a newly installed shower support may not be properly sized to receive an original shower head and vice versa. In order to limit unnecessary expanses on part of a consumer, the flange 170 of the universal fitting 140 is formed with an outer peripheral wall 162 gradually narrowing toward the inner threaded end 166. Preferably, the outer peripheral wall has a frustoconical shape. However, it is conceivable within the scope of the invention to provide this outer wall 162 with various polygonal shapes as long as it has differently sized opposite ends. As a consequence, the universal fitting 140 can slide along differently sized inner surfaces 142 of the shower support 114 until a portion of the relatively wide outer end of the flange 170 facing the shower head frictionally engages the inner surface 142.

The mounting bracket and the shower holder preferably are made of polymeric material by means of an injection molding technique. However other materials, such as stainless steel, can be successfully employed. Although the invention has been explained in relation to its preferred embodiment, it is understood that many other possible modifications and variations can be made without departing from the spirit and scope of the invention as recited in the appending claims.

What is claimed is:

1. An adjustable mount assembly for removably attaching a showerhead to a water supply pipe, comprising:

a mounting bracket having a bowed mounting flange with two ends spaced from each other by a gap and sized to receive the pipe;

said two ends of said bowed mounting flange being flexible for radially sliding over a periphery of the pipe;

a holder for the showerhead;

an attaching assembly rotatably connecting the holder to the mounting bracket; and said mounting bracket further includes a bearing surface extending from the bowed mounting flange and the holder further includes a support plate having a peripheral rim pressing against the bearing surface.

2. The adjustable mount defined in claim 1 wherein the support plate and the bearing surface have substantially the same radius.

3. The adjustable mount defined in claim 1, wherein said support plate includes a surface having an edge formed with a beveled surface, said mounting bracket further comprising a collar having an inner surface which forms a pocket extending complementary to and receiving said edge of said support plate during angular displacement.

4. The adjustable mount defined in claim 1 wherein said mounting bracket further has a stopper controllably displaceable toward and away from said support plate to engage a blind slot in an inner side of said support plate.

5. The adjustable mount defined in claim 1 wherein the bearing surface further includes a friction pad to provide friction between the mounting bracket and the holder.

6. An adjustable mount for attaching a shower head to a water supply pipe, comprising:

a bracket having a U-shaped mounting flange for releasably engaging the water supply pipe:

a holder for the shower head;

an attachment assembly rotatably connecting the mounting flange to the holder; and a universal fitting having an outer surface connectable with the holder and an inner surface adaptable to receive the shower head.

* * * * *